United States Patent [19]

Tanonis et al.

[11] Patent Number: 4,542,271

[45] Date of Patent: Sep. 17, 1985

[54] MICROWAVE BROWNING WARES AND METHOD FOR THE MANUFACTURE THEREOF

[75] Inventors: David R. Tanonis, West Lafayette, Ind.; Alexander L. Darbut, Minneapolis, Minn.

[73] Assignees: Rubbermaid Incorporated, Wooster, Ohio; Polymer Engineering Inc., Reynolds, Ind.

[21] Appl. No.: 691,442

[22] Filed: Jan. 14, 1985

Related U.S. Application Data

[63] Continuation-in-part of Ser. No. 658,140, Oct. 5, 1984, abandoned.

[51] Int. Cl.[4] ..... H05B 6/64

[52] U.S. Cl. ..... 219/10.55 E; 219/10.55 M; 99/DIG. 15

[58] Field of Search ..... 219/10.55 E, 10.55 R, 219/10.55 M, 10.55 F; 99/DIG. 15, DIG. 14; 426/241; 427/204, 215

[56] References Cited

U.S. PATENT DOCUMENTS

| | | | |
|---|---|---|---|
| 2,830,162 | 4/1958 | Copson et al. | 219/10.41 |
| 3,701,872 | 10/1972 | Levinson | 219/10.55 |
| 3,853,612 | 12/1974 | Spanoudis | 219/10.55 E X |
| 4,190,757 | 2/1980 | Turpin et al. | 219/10.55 |
| 4,266,108 | 5/1981 | Anderson et al. | 219/10.55 E |
| 4,362,917 | 12/1982 | Freedman et al. | 219/10.55 E |
| 4,450,334 | 5/1984 | Bowen et al. | 219/10.55 E |
| 4,454,403 | 6/1984 | Teich et al. | 219/10.55 E |
| 4,496,815 | 1/1985 | Jorgensen | 219/10.55 E |

*Primary Examiner*—C. L. Albritton
*Assistant Examiner*—M. M. Lateef
*Attorney, Agent, or Firm*—Renner, Kenner, Greive & Bobak

[57] ABSTRACT

A microwave browning ware (10) comprises a body (11) formed of a member transparent to microwave energy having a base (16) and a sidewall (18), the sidewall carrying an inwardly directed shelf (22); a metallic pan (12) having an upper cooking surface (39) and a lower surface (42) and having an edge (23) adapted to be supported by the shelf and maintain a clearance (28) from the sidewall. A heating matrix (13) absorbent to microwave energy is cured to the lower surface of the metallic pan, a binder material (14) is located between the edge of the pan and the shelf capable of withstanding the heat from the metallic pan without melting or degrading, resulting from the absorption of microwave energy by the heating matrix and, a cavity (36) is formed between the metallic pan and the base which houses the heating matrix therein. A method for the manufacture of such browning ware is also provided. The heating matrix comprises 100 parts by weight of a plastic matrix and from about 100 to about 500 parts per 100 parts of plastic matrix of magnetite particles dispersed evenly throughout the plastic matrix.

54 Claims, 3 Drawing Figures

MICROWAVE BROWNING WARES AND METHOD FOR THE MANUFACTURE THEREOF

CROSS-REFERENCE TO RELATED APPLICATIONS

This application is a continuation-in-part of U.S. Ser. No. 658,140, filed Oct. 5, 1984 and now abandoned.

TECHNICAL FIELD

This present invention is directed toward browning dishes and related wares for use in microwave ovens. A method for the manufacture of such wares is also a feature of the invention. As is known, cooking by microwave energy is faster than by conventional means, inasmuch as microwave energy has the ability to penetrate deeply into food materials and produce heat instantaneously as it penetrates. This is in sharp contrast to conventional heating which depends on the conduction of heat from the food surface to the inside. In microwave cooking the surface temperatures of foods rarely exceeds 100° C., therefore, most foods cooked in a microwave oven lack the brown surface color achieved using conventional methods. For instance, baked goods do not obtain a favorable brown crust and meat usually has a gray surface appearance when prepared in a microwave oven. To enhance the surface appearance of food cooked in a microwave oven a browning device is often required.

BACKGROUND ART

When microwave ovens were first marketed for home kitchen use, the customary experience was for the food to warm and cook but not the container. Although the container often became warm, this was due to conduction of heat from the food and therefore the dish was limited to the heat of the food or some temperature less. This is still the situation today where "conventional" microwave cooking is employed utilizing cooking wares that are not heated by the oven but rather indirectly, by the food.

Notwithstanding the past and existing experiences, there was a recognition that the dish could also serve as a cooking surface to the food and therefore items have been developed which do not heat when subjected to microwave energy. This discovery was based on the phenomenon that some materials will absorb microwave energy, converting it to heat and these are said to be lossy as contrasted with transparent materials through which microwave energy passes without generation of heat. By making a cooking ware of lossy material, food can be cooked at the surface or exterior by conduction as well as by absorbing microwave energy.

One early approach was set forth in U.S. Pat. No. 2,830,162 wherein ferrite materials were included in the body of a cooking utensil. Ferrites absorb microwave energy to a temperature, the Curie temperature, beyond which power absorption decreases and heating does not continue. This property is well known as the Curie effect which was defined in the patent as the capacity of an element to resist additional conversion of radio frequency energy into heat after such element has been heated to a critical temperature constituting the Curie temperature for such material.

U.S. Pat. No. 3,701,872 also defines an implement for converting microwave energy into heat energy for use primarily in cooking. The implement includes a body transparent to microwave energy, preferably glass or ceramic, which contains a bed of resistive particles such as ferrites or carbon which will arc and form heat. A heat conducting element such as copper is interposed between the bed and a cooking surface to transfer the heat to the latter. The patent indicates that as the resistance of the particles varies, so does the heat, therefore, carbon can be utilized for refractory processes while ferrites are suited for household cooking.

U.S. Pat. No. 4,190,757 discloses yet another heating implement for microwave energy in the form of a disposable package. The package includes a lossy microwave energy absorber which becomes hot and transfers heat to the food in the package. The working layer of the package or heating body includes an upper structural member for support and heat resistance such as aluminum, copper, ceramic foil, cement or the like and a heating layer having a lossy substance capable of reaching a temperature above 100° C. The latter substance is preferably a coating, likened to a thin layer of paint comprising a binder and a ferrite or similar material including powdered and granular $Fe_3O_4$, other metallic oxides, carbides and dielectrics such as carbon.

U.S. Pat. No. 4,266,108 discloses a later development in microwave heating devices again relying on a lossy material in heat transfer relationship with a microwave reflective member which heats and cooks the food. The novelty is based upon selection of a magnetic ferrite containing material i.e., ferrites in pellet form or in a layer modified with agents such as glass frit, which is adhered to be reflective member with a bonding agent. The ferrite containing material of the invention has a specific volume reisistivity, expressed in ohm cm of greater than a value of $\text{Log } R=(Tc/100)+2$ where Tc is the Curie temperature of the ferrite material.

U.S. Pat. No. 4,450,334 dicloses a microwave pizza maker comprising a metallic pan and cover and a microwave transparent base. A layer of ferrite particles is attached to the underside of the pan to absorb energy and produce heat. The particles are preferably dispersed in a plastic layer, namely, high temperature silicone, 0.05 inches thick and bonded to the underside of the pan in any conventional manner.

Lastly, U.S. Pat. No. 4,454,403 discloses a heating apparatus which also employs a heat conductive layer to which is bonded a layer of lossy material. The latter is again described as a ferrite material dispersed in a high temperature plastic such as silicone.

Thus, as is evident, a varity of dishes and related wares have been based upon ferrite particles, carbon, metallic oxides and the like bonded to a transparent, conductive material or otherwise juxtaposed therewith. While specific lossy materials are specified, the material in which they have been dispersed, where dispersion is employed, has not been given as specific attention except for the two patents above which call for silicone rubber. It is believed that a novel browning ware can be provided which employs a unique plastic matrix and magnetite as the lossy material.

DISCLOSURE OF THE INVENTION

In general, the microwave browning ware of the present invention comprises a body formed of a member transparent to microwave energy having a base and a sidewall, the sidewall carrying an inwardly directed shelf; a metallic pan having an upper cooking surface and a lower surface, said pan providing an edge adapted to be supported by the shelf and maintain a clearance from the sidewall. A heating matrix absorbent to microwave energy is cured to the lower surface of the metallic pan and comprises 100 parts by weight of a plastic matrix and from about 200 to about 500 parts per 100 parts of plastic matrix of magnetite particles dispersed evenly throughout the plastic matrix. Lastly, a binder material is located between the edge of the pan and a shelf capable of withstanding the heat from the metallic pan without melting or degrading, resulting from the absorption of microwave energy by the heating matrix and, a cavity is formed between the metallic pan and the base which houses the heating matrix therein.

The microwave browning ware of the present invention can be provided in a variety of sizes and shapes to brown foods such as pizzas, pancakes, meats, potatoes and the like which do not surface brown or cook well in a normal microwave oven. Additionally, the browning ware described herein could be extended to uses as a waffle maker, hamburger fryer, pizza crisper, deep fryer, poacher, popcorn maker, wok and the like by alterations in the structure thereof.

Primarily, the device described herein will provide food prepared by microwave with the same appearance as food conventionally prepared. Browning, combined with microwaving, will lock in the flavor and juices of the food in a manner experienced by conventional cooking but at the speed of microwave cooking. The device is useful generally for toasting of bread, sandwiches and appetizers, warming of frozen TV dinners, broiling of fish, meat, appetizers and the like, frying of fish, meat, eggs, pancakes and the like and baking of breads, rolls, cakes, desserts and the like.

A method for the manufacture of the browning ware disclosed herein is also provided which includes the steps of forming a mixture of plastics containing from about 200 to about 500 parts by weight of magnetite particles per 100 parts of plastic dispersed evenly throughout the mixture, applying the mixture to the underside of a metallic pan and curing it in contact therewith to form a heating matrix absorbent to microwave energy and, bonding the underside of the metallic pan to a body formed of a member transparent to microwave energy with a binder material capable of withstanding the heat from the metallic pan without melting or degrading resulting from the absorption of microwave energy by the heating matrix, the metallic pan and the body defining a cavity therebetween, the heating matrix being housed therein.

PREFERRED MODE FOR CARRYING OUT THE INVENTION

Figure 1:
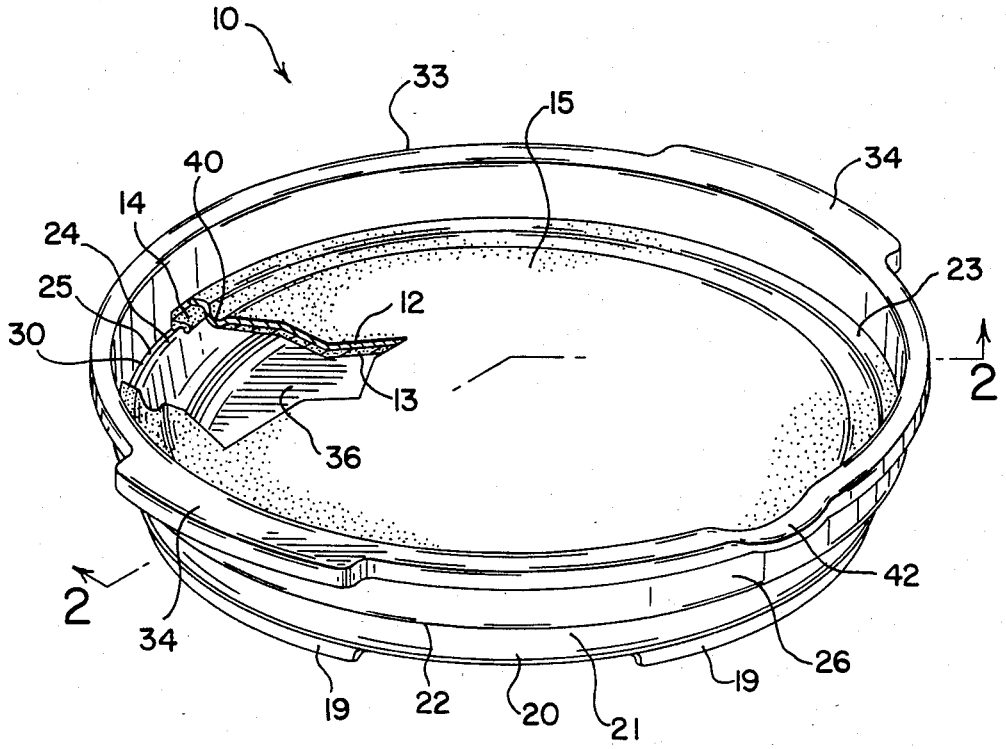
FIG. 1 is a perspective view with a portion broken away to show detail of a typical browning ware according to the present invention.
Figure 2:
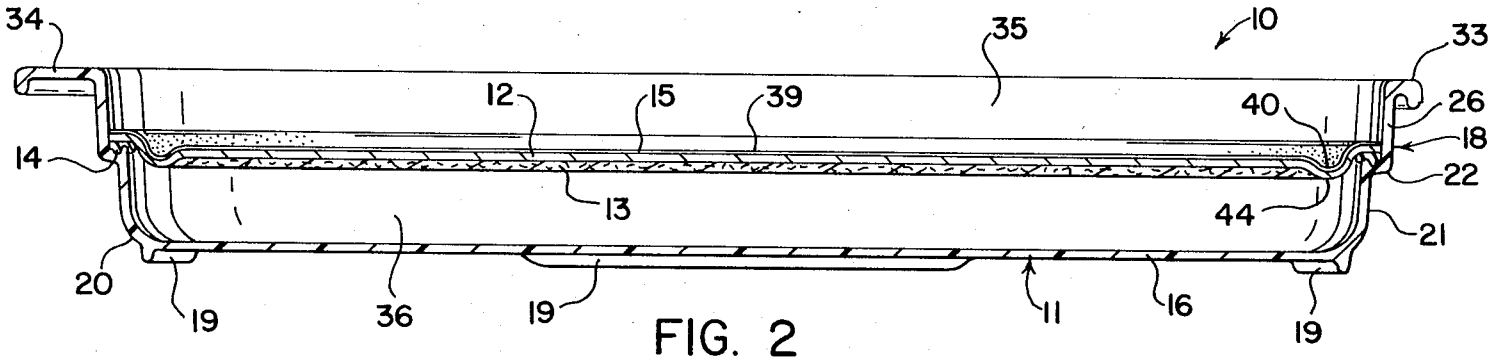
FIG. 2 is a cross-sectional side elevation taken substantially along the line 2—2 in FIG. 1 and, FIG. 3 is an enlarged view in section of the sidewall and edge detail of the browning ware.

With reference to FIGS. 1 and 2 a typical configuration of browning ware according to the present invention is indicated generally by the numeral 10. Although the article is depicted as circular, it will be appreciated that other shapes including square and rectangular can also be selected. The elements comprising the browning ware 10 include a body or pan-like number 11, a metallic pan 12 upon which the food is cooked and a heating matrix 13, bonded to the underside of pan 12. In the preferred embodiment the pan is affixed to the body in nonremovable fashion with a binder material 14 which will be discussed in greater detail hereinbelow.

Before continuing the discussion of the structure of browning ware 10, the foregoing elements shall be described in greater detail. Starting first with the body 11 it is constructed of a material that is transparent to microwave energy so as not to interfere with microwave cooking of the food with which it is used. Such materials are well known in the art and include glass, ceramics and plastics. These materials should possess a heat resistance to at least 150° C. because while they are not heated directly by microwave energy, they will be heated indirectly by the cooking food and heating due to absorption of microwave energy by the heating matrix 13. A preferred material to be selected is a thermostat polyester because it is readily moldable to various configurations, such as depicted in the drawings, it possesses fairly good strength so as to minimize the risk of breakage and, it does possess more than adequate heat resistance for its intended purpose.

With respect to the metallic pan 12, any good conductor of heat can be employed such as aluminum, steel or copper. However, the present invention employs aluminum which can be relatively thin because of the reinforcement it receives from the heating matrix 13 described hereinbelow. Thus, while a suitable thickness for cooking could be as great as 0.125 inch (3.175 cm) the pan 12 can be as thin as 0.045 to 0.060 inch (0.1143 to 0.1524 cm) and still possess sufficient rigidity to cook substantially any food placed thereon.

The heating matrix 13 is a novel element of the present invention. It combines a unique blend of three plastics and magnetite as the lossy material which is dispersed evenly throughout the plastic. Notwithstanding the fact that the Curie phenomenon has been known for years and various materials such as ferrites have been employed in other microwave browning articles, little if any attention has been directed toward optimizing the heating speed. By the use of magnetite particles, rather than ferrites, and having them dispersed in the unique blend of plastics set forth herein, a fast heating time has been obtained and with the use of a relatively thin layer of microwave absorbent material, the matrix 13.

The matrix 13 comprises three plastics, a polyester resin, styrene monomer and either polyethylene powder or an acrylic emulsion to equal 100 parts. A polyester resin manufactured by U.S. Steel is modified by triallyl cyanurate (TAC) as a crosslinking monomer and is quite suitable. Other polyester resins such as the 470 Series of vinyl esters, available from Dow Chemical, could be substituted therefor. The polyester resin functions to adhere the matrix to the pan by a heat curing step as discussed hereinbelow. During heating, the polyester resin and styrene copolymerize. The resin is employed in an amount ranging from about 30 to about 50 percent by weight with about 39 to 40 percent being preferred.

The second plastic is styrene monomer and it is employed in an amount ranging from about 10 to about 30 percenty by weight with about 23 to 24 percent being preferred. The third plastic is either polyethylene powder or an acrylic emulsion. The former component has a particle size of about one to 15 microns and a density of 0.924 g/cc and can be obtained from U.S.I. The latter comprises a solution of acrylic polymer in styrene monomer, approximately 40 weight percent. Either component is employed in an amount ranging from about 30 to about 50 percent by weight, with about 36 to 37 percent being preferred, and forms an alloy with the polyester/styrene copolymer remaining mechanically mixed therein after polymerization. The purpose of the polyethylene or acrylic emulsion is to prevent shinkage because it will expand at polymerization temperatures while the polyester resin contracts. The three plastics should total 100 parts of resin.

Magnetite is the predominant component in the matrix and it is employed in an amount ranging from about 100 to about 500 per hundred parts of resin (phr) and preferably from about 250 to about 450 phr. Magnetite has the formula $Fe_3O_4$ and has a cubic structure as compared to the ferrites, based upon the iron oxide $Fe_2O_3$ which have a hexagonal structure. Particle size of the mangnetite can range between about 70 and 250 microns. One suitable source of material is Bethlehem iron oxide Sphere-OX 70, which has a particle size of 90 to 170 microns. The Curie temperature of this magnetite is 585° C.

Bethlehem sphere magnetite is a synthetic iron oxide sphere or pellet having a core of FeO and a shell of $Fe_3O_4$. It includes as other physical properties, a resistivity of 5200 micro ohm-cm and a particle size of 100 to 150 microns. Naturally occuring iron oxide is substantially pure $Fe_3O_4$. St. Joe M-25 iron oxide is also exemplary and it has a Curie temperature of 585° C., a resistivity of 5200 micro ohm-cm and a particle size of 8 to 10 microns.

Blending of particle sizes is useful to provide differences in the heating properties of the matrix 13. Specifically, there is a direct relationship between increased temperature rise of the matrix and its thickness. However, the matrix can be made thinner and still heat to a higher degree by employing magnetite particles of varying sizes. The reason for this is based upon micropacking. When relatively large magnetite particles are added to the plastic matrix, there is a limit to how many particles can be packed together. Voids that occur between adjacent particles are filled by the plastic, however, a smaller magnetite particle will fill these voids as will result in a higher content of lossy particles per volume of heating matrix. In this manner, the heating matrix can be made thinner.

The volume resistivity of the matrix is determined by the formula $$p_v=(ARv/t) \text{ ohm-cm,}$$

where $p_v$ is volume resistivity in ohm-cm,

A is area in sq cm and

Rv is resistence in ohms.

Volume resistivity of the matrix can range from about $2.50\times10^7$ to $4.10\times10^7$. The average value for the matrix 13 exemplified hereinbelow was determined to be $3.11\times10^7$ ohm-cm.

In addition to the foregoing components, the matrix is also formulated with trace amount, less than one phr of copper naphthenate as a chemical inhibitor to suppress the polymerization exotherm, t-butyl perbenzoate or other free radical initiator for polymerization and p-benzoquinone as another chemical inhibitor. It is to be understood that the last three components are employed as typical inhibitors and initiators and that the matrix 13 could employ equivalent compositions. Therefore, the present invention should not be limited to the selection of the three set forth herein which are only for illustrative purposes.

The preparation of the matrix includes dry blending of the magnetite and the polyethylene powder in a vessel of suitable volume. The liquid components, which include all other materials to be added to the composition, are blended together under high shear mixing conditions until a material temperature of ambient plus 8° C. is reached. The dry blended components are then slowly added to the liquid components while the mixer is running at high shear. The matrix is blended until good dispersion is noted. Where the acrylic emulsion is substituted for polyethylene powder, the emulsion is blended with the other liquid components to which the magnetite is slowly added.

The resulting mixture is then applied directly to the underside of the metallic pan 12. It is spread to a fairly uniform thickness and covers substantially the total underside although it could also be employed partially on the underside, randomly or in a predetermined pattern. Depending upon the heat conducting properties of the pan 12, a partial under coating could readily achieve total heating of the top surface. Nevertheless, the matrix of the present invention does not present a large cost and therefore, a total coating is most readily employed.

The matrix is then cured directly to the pan 12 by heating both in an oven for a period of time of from about 40 to 90 minutes at a temperature of at least 170° C. up to about 275° C. Upon cooling, the pan can be assembled with the base as described hereinbelow.

In order to minimize the effort of cleaning of the pan 12, the upper surface is preferably given a coating 15 of a non-stick plastic such as Teflon® (tetrafluoroethylene fluorocarbon polymers) or the like, prior to receiving the matrix layer 13. To insure that both upper and under surfaces of the pan are clean, thereby providing maximum bonding of the matrix 13 and protective coating 15, the pan is initially given a conversion coating. As is well known to those skilled in the art, this can be done by initially vapor degreasing the pan 12, to remove any oils employed in manufacturing. The pan 12 is then sprayed, washed or rinsed in a three to five percent solution by weight of iron phosphate in water at a temperature of 55° to 77° C. for a period of two to five minutes. The pan 12 is then rinsed in pure water and dried by infrared energy.

Once the matrix has been cured to the pan, a very strong bond is obtained, one that is resistant to cracking and subsequent separation from the pan and which possesses better adhesion than existing matrices employed heretofore in the art. This is important inasmuch as the browning ware 10 can be expected to encounter differential expansion due to repeated heating and cooling cycles as well as dropping or other mishandling during use in the kitchen. As noted hereinabove, the matrix 13 also adds integrity or rigidity to the pan 12, allowing the use of thinner gauge metal in the formation thereof.

As an optional feature, the matrix could contain a fiberglass reinforcement non-woven mat at the base thereof i.e., bottom side, away from the pan 12. The purpose would be to prohibit to an even further degree the breakage of the matrix. Where a heat sink is desirable, glass beads or glass microspheres can also be employed in the matrix in an amount of from about 70 to about 100 phr with a similar reduction in the magnetite.

Important features of the matrix composition thus described include the fact that the volume resistivity is different than existing microwave absorbing layers, hence the heating time can be shortened. Another result from the combined usage of the plastics and of magnetite in the matrix is that the thickness of the heat absorbing layer is decreases, providing savings in cost as well as weight of the overall browning device 10. Yet another benefit of the matrix 13 is that by curing it directly to the pan 12, adhesives are not required and the bond actually formed between the two layers is exceptionally strong and resistant to heat. The matrix is also nontoxic, an important characteristic for manufacturing and even more so during use. Lastly, the curing time of the matrix is faster than previously known matrices. In conjunction with the use of this matrix is also the fact that the structure of the browning device has been improved over existing designs.

In order to affix the metallic pan 12 with its underlying heating matrix 13 to the body 11, a heat resistant adhesive is employed. A preferred material for manufacturing facility is a room temperature vulcanizable (RTV) silicone adhesive such as Silastic obtained from Dow Corning Co. Other adhesives that could be substituted therefor include epoxy and/or acrylic materials.

With specific reference again to the drawings, the structural detail of the browning ware 10 shall next be discussed. The body member 11 includes the base 16 and a sidewall, indicated generally by the number 18. The base 16 forms a complete bottom to the article 10 and is provided with a plurality of feet 19 about its periphery upon which to rest in the microwave oven. The sidewall member 18 curves gently at 20 upwardly to form a first portion or lower sidewall 21.

Figure 3:
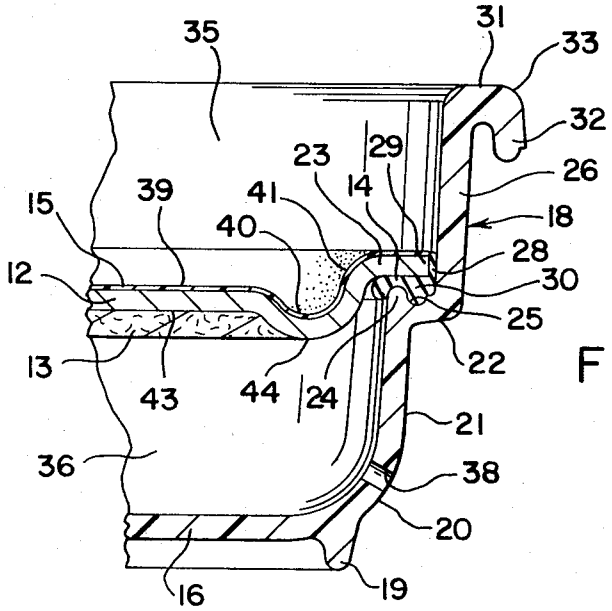

Approximately mid-way of the sidewall 18 a shelf or step 22 is provided which, as depicted, extends outwardly or beyond the base 16. The shelf 22 provides a point at which the peripheral edge 23 of the pan 12 is affixed to the body member 11. As is most clearly depicted in FIG. 3 the first portion 21 of sidewall 18 terminates in a peripheral lip 24. Adjacent the lip is a peripheral recess 25, which is below the edge 23 of pan 12. It will also be noted that contiguous with the recess 25 and opposite the lip 24, the shelf 22 continues for a short distance and then curves upwardly into the second portion of the sidewall 18, or upper sidewall 26. A clearance 28 is thus provided between the rim 29 of pan 12 and sidewall 18.

During manufacture of the article 10, a bead of adhesive binder material 14 is deposited within the peripheral recess 25. The pan 12 is subsequently positioned down into the body member 11 until it rests just above lip 24 forming a cavity 30 from which excess binder 14 is extruded upwardly into the clearance 28, essentially forming a seal between the rim 29 of pan 12 and sidewall 18. This seal is designed to join the pan 12 to the sidewall 18 and prohibit the passage of liquid, resulting from cooking, or other foodstuff from penetrating into the cavity 30. In this manner, cleaning is simplified and the integrity of the bond between the pan 12 and shelf 22 is fortified. As noted in FIGS. 2 and 3, the binder material is also extruded in front of the lip 24 which provides a greater surface area for adhesion as well as providing an insulation between the pan 12 and shelf 22.

Continuing the discussion of the sidewall 18, the second portion terminates with an outwardly extending flange 31 and downturned edge 32 which forms in essence a continuous rim 33 for gripping the article 10. Alternatively, separate handles 34 can be molded into the sidewall 18 with or without the continuous rim 33.

By providing the shelf 22 at approximately the middle of sidewall 18, the second portion 26 forms a sidewall for the cooking area 35, to contain the food cooked therein as well as protecting the user from the hot surface of the pan 12. A second function of the shelf 22 is that it allows the formation of an essentially closed cavity 36 between the area bounded by the pan 12, base 16 and lower sidewall 21. The cavity 36 lifts the matrix 13 from the floor of the microwave oven for access to the microwaves and, being closed, it allows warm air radiating from the heat matrix 13 to maintain the pan 12 hot for longer periods of time. Of course, in order to equalize pressure resulting from the air in the cavity, vent holes 38 are provided in the bottom 16 or the curved portion 20 contiguous therewith.

It will be appreciated by those skilled in the art that the separation of the lower and upper sidewalls as depicted in the drawings is a molding expedient in order to form the shelf 22. Thus, the sidewall 18 could also be formed having a continuous exterior and a shelf extending inwardly for the pan 12 if a flexible material were employed for the body to allow removal from the mold. Thus, the body 11 of the present invention is not necessarily limited to the structure depicted in the drawings and in this regard the sidewall need not be essentially normal to the base, as inclined, sloping walls would function as well.

With respect next to the pan 12, it extends substantially flat to provide an even cooking surface upper surface 39. Toward the periphery, the pan 12 is provided with a continuous recess 40 for the collection of liquids resulting from cooking. The recess 40 is bounded at its outermost edge by a rise in the pan 12 forming a short sidewall 41 in the pan 12 which then terminates in the edge 23 discussed hereinabove by which mounting to the body 11 occurs. In the preferred embodiment, the edge 23 is higher than the lower cooking surface of pan 12, again to minimize the spilling of liquids against the upper sidewall 26. Nevertheless, liquids can be deliberately poured off over a trough 42 formed in the upper sidewall 26.

It will also be understood by those skilled in the art that the rim 29 could be curved upward (not shown) to create a deep pan for use in deep frying. In such an embodiment, the rim could extend as high as the upper sidewall or even higher but in no instance should contact between the two exist, so as to avoid heat degradation of the sidewall. Based upon the disclosure herein, it would be possible to fill the area with the binder 14 to form an insulating seal or to eliminate the upper sidewall altogether, the extended rim serving to contain the food and frying oil.

Although the surface of pan 12 is preferably smooth and flat in order to brown maximum areas of the food, the design of the pan could also provide raised areas to impart grill marks as well or to impart a waffle-like pattern to waffle batter and the like. In this latter conjunction, an upper or mating waffle-like pan 12 and matrix 12 could be employed on top of the food or batter as would be understood by those skilled in the art. Such a device is not more fully described herein inasmuch as the primary use of the browning ware 10 is not as a waffle iron.

The heating matrix 13 described hereinabove is applied to the underside or lower surface 43 of the pan 12 and is preferably spread uniformly to the knee 44, formed by the bottom of recess 40 in the pan 12. This application is not mandatory, but does aid in the application of a uniform, pre-determined thickness of the matrix 13. Also, in this manner the matrix 13 is conveniently limited to the maximum area of the cooking surface and does not extend to the sidewall or binder material 14.

Having thus completed the description of the browning ware 10, two specific examples thereof shall next be provided. Separate heating matrices 13 were prepared having the compositions A and B set forth in Table I, all plastic parts being in terms of percent by weight and the remaining components as parts per 100 parts of plastic.

TABLE I

| Compositions of Heating Matrix | | |
|---|---|---|
| Component | A | B |
| Polyester resin[a] | 39.7 | 40.8 |
| Styrene monomer | 23.8 | 52.3 |
| Polyethylene powder | 36.5 | — |
| Acrylic emulsion[b] | — | 6.9 |
| Magnetite[c] | 375.0 | 83.7 |
| Magnetite[d] | — | 195.2 |
| Copper naphthenate | 0.4 | 0.2 |
| t-butyl perbenzoate | 0.6 | 0.5 |
| p-benzoquinone | 0.3 | 0.6 |

[a]modified with triallyl cyanurate
[b]40 wt. percent acrylic polymer
[c]Bethlehem Sphere OX-70
[d]St. Joe M-25 iron oxide The matrix A was prepared by dry blending the magnetite and polyethylene powder in a 500 ml Griffin beaker using a spatula. A uniform mechanical blend was produced. In a separate 500 ml Griffin beaker, the polyester resin, styrene monomer, copper naphthenate, t-butyl perbenzoate and p-benzoquinone were mixed under a Fisher lab stirrer having a 3.75 cm diameter impeller at high shear setting. Mixing was halted when the liquid temperature was about 8° C. greater than ambient. The dry blended components were then slowly added to the liquid components while the stirrer was again started and operated until all of the dry components were added and evenly dispersed.

The matrix B was prepared by a similar procedure except the two magnetite materials were mixed together without any polyethylene and the liquid components included the acrylic emulsion. Although a blend of magnetite particles was employed with the acrylic emulsion for purposes of exemplification, the present invention is not so limited and therefore blending of magnetites with polyethylene as well as the use of one magnetite with the acrylic emulsion are within the scope of the invention.

The pan 12 was formed from 0.060 inch (0.1524 cm) aluminum. The depth of recess 40 from the cooking surface was 0.090 inch (0.229 cm) and the distance between edge 23 and the cooking surface was 0.125 inch (0.318 cm). The heating matrix A was applied evenly to the underside of the pan 12 to a thickness of 0.090 inch (0.229 cm). A polytetrafluoroethylene non-stick coating was applied to the upper surface of pan 12.

After the matrix 13 was cured to the pan 12 the pan was joined to the body member 11 with Silastic silicone adhesive as the binder material. The body comprised polyester resin compression molded to the design appearing in FIG. 1.

The device 10 was placed in a 650 watt microwave oven and subjected to full power. In eight minutes it reached a maximum operating temperature of 232° C.

An initial cooking test was performed using a commercially prepared brand of frozen pizza of about 10 inches (25.4 cm) in diameter. The device 10 was placed in the 650 watt microwave oven which was set at full power and preheated for eight minutes. The 10 inch pizza (frozen) was placed on the cooking surface and the assembly placed back into the oven. The pizza/device assembly was subjected to full power for four minutes, manually rotated 180° and again subjected to full power for four minutes. The assembly was removed from the oven and placed on a countertop to stand for two minutes. A cripsy, brown crust was observed and deemed acceptable.

A second pan 12 was formed as described hereinabove and received a uniform coating of matrix B to the underside to a thickness of 0.030 inch (0.076 cm). A polytetrafluoroethylene coating was also applied to the upper surface, matrix B was cured to the pan 12 and joined to the body member 11. The device 10 was tested with and without food as previously described and performed comparably. Thus, the mixture of magnetite particles and acrylic emulsion in the matrix 13 is also operable. Although matrix B was thinner than matrix A the thickness is not crucial to practice of the present invention and can be varied to accommodate manufacturing and design characteristics as well as heating properties of the device 10.

Based upon the foregoing disclosure, it should now be apparent that the browning ware described herein provides a novel combination of structure and composition for browning foods in a microwave oven. It should also be apparent to those skilled in the art that the method for manufacture of the subject invention can readily be performed in conjunction with conventional apparatus for plastic and metal forming, coating and like. It is to be understood that any variations evident fall within the scope of the claimed invention; therefore, the selection of specific component ingredients and structural variations can be determined without departing from the spirit of the invention herein disclosed and described. Moreover, the scope of the invention shall include all modifications and variations that may fall within the scope of the attached claims.

We claim:

1. A microwave browning ware comprising:

a body formed of a member transparent to microwave energy having a base and a sidewall, said sidewall carrying an inwardly directed shelf;

a metallic pan having an upper cooking surface and a lower surface said pan providing an edge adapted to be supported by said shelf and maintain a clearance from said sidewall;

a heating matrix absorbent to microwave energy cured to said lower surface of said metallic pan comprising: 100 parts by weight of a plastic matrix and from about 100 to about 500 parts per 100 parts of plastic matrix of magnetite particles dispersed evenly throughout said plastic matrix;

a binder material located between said edge of said pan and said shelf capable of withstanding the heat from said metallic pan without melting or degrading, resulting from the absorption of microwave energy by said heating matrix; and a cavity formed between said metallic pan and said base, said heating matrix being housed therein.

2. A microwave browning ware, as set forth in claim 1, wherein said plastic matrix comprises:

from about 30 to about 50 parts by weight of a polyester resin;

from about 30 to about 50 parts by weight of sytrene monomer; and from about 10 to about 30 parts by weight of polyethylene, totalling 100 parts by weight.

3. A microwave browning ware, as set forth in claim 2, comprising:

39.7 weight percent polyester resin;

23.8 weight percent styrene monomer;

36.5 weight percent polyethylene powder; and 375.0 parts of magnetite per 100 parts of said plastic matrix.

4. A microwave browning ware, as set forth in claim 1, wherein said magnetite is selected from the group consisting of naturally occuring iron oxide and synthetic iron oxide spheres having a core of FeO and a shell of $Fe_3O_4$.

5. A microwave browning ware, as set forth in clim 4, wherein the Curie temperature of said magnetite is 585° C.

6. A microwave browning ware, as set forth in claim 5, wherein said magnetite is synthetic iron oxide, having a Curie temperature of 585° C., a resistivity of 5200 micro ohm-cm and a particle size of 100 to 150 microns.

7. A microwave browning ware, as set forth in claim 4, wherein said heating matrix comprises a mixture of at least two magnetites each having a different particle size.

8. A microwave browning ware, as set forth in claim 1, wherein said plastic matrix comprises:

from about 30 to about 50 parts by weight of a polyester resin;

from about 30 to about 50 parts by weight of styrene monomer; and from about 10 to about 30 parts by weight of an acrylic emulsion, totalling 100 parts by weight.

9. A microwave browning ware, as set forth in claim 8, comprising:

40.8 weight percent polyester resin;

52.3 weight percent styrene monomer;

6.9 weight percent acrylic emulsion; and 278.9 parts of magnetite per 100 parts of said plastic matrix.

10. A microwave browning ware, as set forth in claim 1, wherein said magnetite is selected from the group consisting of naturally occuring iron oxide and synthetic iron oxide spheres having a core of FeO and a shell of $Fe_3O_4$.

11. A microwave browning ware, as set forth in claim 10, wherein the Curie temperature of said magnetite is 585° C.

12. A microwave browning ware, as set forth in claim 11, wherein said magnetite is synthetic iron oxide, having a Curie temperature of 585° C., a resistivity of 5200 micro ohm-cm and a particle size of 100 to 150 microns.

13. A microwave browning ware, as set forth in claim 10, wherein said heating matrix comprises a mixture of at least two magnetites each having a different particle size.

14. A microwave browning ware, as set forth in claim 10, wherein both said magnetites are synthetic iron oxide, have a Curie temperature of 585° C. and a resistivity of 5200 micro ohm-cm; one said magnetite has a particle size of 100 to 150 microns and the other said magnetite has a particle size of 8 to 10 microns.

15. A microwave browning ware, as set forth in claim 1, wherein said heating matrix further comprises from about 70 to 100 parts of glass beads per 100 parts of said plastic matrix.

16. A microwave browning ware, as set forth in claim 1, wherein said heating matrix carries a non-woven fiberglass mat reinforcement located away from the interface between said metallic pan and said heating matrix.

17. A microwave browning ware, as set forth in claim 1, wherein said sidewall is divided into first and second portions, said shelf being carried therebetween.

18. A microwave browning ware, as set forth in claim 17, wherein said shelf separates said first and second portions, said first portion terminates in a lip which extends above said shelf and said shelf carries a recess adjacent said lip.

19. A microwave browning ware, as set forth in claim 18, wherein a cavity is formed between said shelf and said metallic pan and between said lip and said sidewall second portion for said binder material.

20. A microwave browning ware, as set forth in claim 19, wherein said binder material is extruded into said clearance and over said lip thereby separating said metallic pan from said lip and said sidewall.

21. A microwave browning ware, as set forth in claim 1, said upper surface of said pan carrying a depression near its periphery extending below the horizontal plane of said lower surface for the collection of liquids.

22. A microwave browning ware, as set forth in claim 21, said upper surface terminating in a peripheral ridge above the horizontal plane of said cooking surface.

23. A microwave browning ware, as set forth in claim 22, wherein said shelf separates said first and second portions, said first portion terminates in a lip which extends above said shelf and wherein said peripheral ridge extends over said shelf and said lip and is separated therefrom by said binder material.

24. A microwave browning ware, as set forth in claim 23, said upper surface carrying a coating of a material to prevent foods from sticking thereon.

25. A microwave browning ware, as set forth in claim 1, said pan having a dimension greater than said base but less than said second portion.

26. A microwave browning ware, as set forth in claim 1, said base having vent means for the communication of air between cavity and the atmosphere.

27. A microwave browning ware, as set forth in claim 1, wherein said member transparent to microwave energy comprises polyester.

28. A microwave browning ware, as set forth in claim 1, wherein said binder material is a room temperature vulcanizable silicone polymer.

29. A method for the manufacture of microwave browning ware comprising the steps of:

forming a mixture of plastic containing from about 100 to about 500 parts per 100 parts of plastic of magnetite particles dispersed evenly throughout said mixture;

applying said mixture to the underside of a metallic pan and curing said mixture in contact therewith to form a heating matrix bonded to said pan absorbent to microwave energy; and bonding said underside of said metallic pan to a body formed of a member transparent to microwave energy with a binder material capable of withstanding the heat from said metallic pan without melting or degrading, resulting from the absorption of microwave energy by said heating matrix, said metallic pan and said body defining a cavity therebetween, said heating matrix being housed therein.

30. A method, as set forth in claim 29, wherein said mixture of plastic comprises:

from about 30 to about 50 parts by weight of a polyester resin;

from about 30 to about 50 parts by weight of styrene monomer; and from about 10 to about 30 parts by weight of polyethylene, totalling 100 parts by weight.

31. A method, as set forth in claim 30, comprising:

39.7 weight percent polyester resin;

23.8 weight percent styrene monomer;

36.5 weight percent polyethylene powder; and 375.0 parts of magnetite per 100 parts of plastic.

32. A method, as set forth in claim 29, wherein said magnetite is selected from the group consisting of naturally occuring iron oxide and synthetic iron oxide spheres having a core of FeO and a shell of $Fe_3O_4$.

33. A method, as set forth in claim 32, wherein the Curie temperature of said magnetite is 585° C.

34. A method, as set forth in claim 33, wherein said magnetite is synthetic iron oxide, having a Curie temperature of 585° C., a resistivity of 5200 micro ohm-cm and a particle size of 100 to 150 microns.

35. A method, as set forth in claim 32, wherein said plastic mixture contains a mixture of at least two magnetites each having a different particle size.

36. A method, as set forth in claim 29, wherein said mixture of plastic comprises:

from about 30 to about 50 parts by weight of a polyester resin;

from about 30 to about 50 parts by weight of styrene monomer; and from about 10 to about 30 parts by weight of an acrylic emulsion, totalling 100 parts by weight.

37. A method, as set forth in claim 36, comprising:

40.8 weight percent polyester resin;

52.3 weight percent styrene monomer;

6.9 weight percent acrylic emulsion; and 278.9 parts of magnetite per 100 parts of plastic.

38. A method, as set forth in claim 36, wherein said magnetite is selected from the group consisting of naturally occuring iron oxide and synthetic iron oxide spheres having a core of FeO and a shell of $Fe_3O_4$.

39. A method, as set forth in claim 38, wherein the Curie temperature of said magnetite is 585° C.

40. A method, as set forth in claim 39, wherein said magnetite is synthetic iron oxide, having a Curie temperature of 585° C., a resistivity of 5200 micro ohm-cm and a particle size of 100 to 150 microns.

41. A method, as set forth in claim 38, wherein said plastic mixture contains a mixture of at least two magnetites each having a different particle size.

42. A method as set forth in claim 41, wherein both said magnetites are synthetic iron oxide, have a Curie temperature of 585° C. and a resistivity of 5200 micro ohm-cm; one said magnetite has a particle size of 100 to 150 microns and the other said magnetite has a particle size of 8 to 10 microns.

43. A method, as set forth in claim 29, wherein said plastic mixture further contains from about 70 to 100 parts of glass beads per 100 parts of said plastic.

44. A method, as set forth in claim 29, including the additional step of:

locating a non-woven fiberglass mat reinforcement in said mixture before said step of curing.

45. A method, as set forth in claim 29, wherein said body has a base and a sidewall, said sidewall is divided into first and second portions, and a shelf is carried therebetween.

46. A method, as set forth in claim 45, wherein said shelf separates said first and second portions, said first portion terminates in a lip which extends above said shelf and said shelf carries a recess adjacent said lip.

47. A method, as set forth in claim 45, wherein said step of bonding includes the steps of:

applying said binder material in said recess and on said shelf;

contacting said metallic pan with said binder material; and extruding said binding material over said lip whereby said pan is supported by said shelf out of contact therewith and said sidewall.

48. A method, as set forth in claim 46, wherein said binder material is a room temperature vulcanizable silicone polymer.

49. A method, as set forth in claim 29, including the additional step of forming said metallic pan with a depression near its periphery, in its upper surface and extending below the horizontal plane of said underside for the collection of liquids, prior to said step of applying.

50. A method, as set forth in claim 29, including the additional step of:

coating the upper surface of said metallic pan with a material to prevent food from sticking thereon.

51. A method, as set forth in claim 29, wherein said step of curing is conducted at a temperature of from about 170° to about 275° C. for a period of time ranging from about 40 to about 90 minutes.

52. A method, as set forth in claim 29, including the additional step of:

providing vent means in said body for the communication of air between said cavity and the atmosphere.

53. A method, as set forth in claim 29, including the additional step of:

subjecting said metallic pan to a conversion coating treatment before said step of applying.

54. A method, as set forth in claim 53, wherein said step of subjecting includes the steps of:

vapor degreasing said metallic pan;

exposing said degreased pan to an aqueous solution of iron phosphate; and thereafter rinsing and drying said pan.

* * * * *

UNITED STATES PATENT AND TRADEMARK OFFICE

CERTIFICATE OF CORRECTION

PATENT NO. : 4,542,271

DATED : September 17, 1985

INVENTOR(S) : David R. Tanonis and Alexander L. Darbut

It is certified that error appears in the above-identified patent and that said Letters Patent are hereby corrected as shown below:

Column 1, line 45, "do not heat" should read --do heat--.

Column 2, line 50, "varity" should read --variety--.

Column 3, line 8, "a shelf" should read --the shelf--.

Column 4, lines 18,19, "thermostat" should read --thermoset--.

Column 4, line 63, "percenty" should read --percent--.

Column 7, line 4, "decreases" should read --decreased--.

Column 7, line 26, "number" should read --numeral--.

Column 7, line 64, "terminates with" should read --terminates eventually with--.

Column 8, line 59, "matrix 12" should read --matrix 13--.

Column 10, lines 34,35, "and like" should read --and the like--.

Claim 2, Column 11, line 1, "sytrene" should read --styrene--.

Claim 5, Column 11, line 17, "clim" should read --claim--.

UNITED STATES PATENT AND TRADEMARK OFFICE

CERTIFICATE OF CORRECTION

PATENT NO. : 4,542,271

DATED : September 17, 1985

INVENTOR(S) : David R. Tanonis et al.

It is certified that error appears in the above-identified patent and that said Letters Patent is hereby corrected as shown below:

Claim 26, Column 12, line 44, "betweem cavity" should read -- between said cavity --.

Signed and Sealed this

*Fourth* Day of *March 1986*

[SEAL]

*Attest:*

DONALD J. QUIGG

*Attesting Officer*

*Commissioner of Patents and Trademarks*